US006929569B1

(12) United States Patent
Wang

(10) Patent No.: US 6,929,569 B1
(45) Date of Patent: Aug. 16, 2005

(54) FOLDABLE BASKETBALL GAME ASSEMBLY

(76) Inventor: Cheng-Liang Wang, No. 57, Chung-Ho Street, Tainan City (TW)

( * ) Notice: Subject to any disclaimer, the term of this patent is extended or adjusted under 35 U.S.C. 154(b) by 0 days.

(21) Appl. No.: 10/827,270

(22) Filed: Apr. 20, 2004

(51) Int. Cl.[7] ..... A63B 69/00
(52) U.S. Cl. ..... 473/433; 473/483; 473/480
(58) Field of Search ..... 473/480, 481, 473/483, 484, 433; 273/398–402

(56) References Cited

U.S. PATENT DOCUMENTS

| | | | | | |
|---|---|---|---|---|---|
| 2,593,758 | A * | 4/1952 | Holmdahl | 473/480 |
| 3,017,183 | A * | 1/1962 | Chalcroft | 473/483 |
| 4,111,420 | A * | 9/1978 | Tyner | 473/481 |
| 4,838,549 | A * | 6/1989 | Woodall | 473/433 |
| 5,165,680 | A * | 11/1992 | Cass | 473/433 |
| 5,312,099 | A * | 5/1994 | Oliver, Sr. | 473/433 |
| 5,539,957 | A * | 7/1996 | Schmidt | 16/331 |
| 5,692,976 | A * | 12/1997 | Yu | 473/433 |
| 5,813,926 | A * | 9/1998 | Vance | 473/448 |
| 6,224,504 | B1 * | 5/2001 | Tien | 473/433 |
| 6,267,696 | B1 * | 7/2001 | Mabe et al. | 473/433 |
| 2002/0068650 | A1 * | 6/2002 | Wang | 473/479 |
| 2004/0058756 | A1 * | 3/2004 | Huang | 473/433 |

* cited by examiner

*Primary Examiner*—Mark S. Graham
(74) *Attorney, Agent, or Firm*—Rosenberg, Klein & Lee

(57) ABSTRACT

A foldable basketball game assembly includes a base, an extendable upright frame connected to an end of the base and an extendable end frame connected to the other end of the base. A board is connected to the upper section of the upright frame and a sound producing member is connected to the board. A hoop is pivotably connected to the sound producing member and a sensor extended from the sound producing member is located in a center of the loop so that when a ball enters the hoop, a pre-set sound is produced.

5 Claims, 11 Drawing Sheets

FOLDABLE BASKETBALL GAME ASSEMBLY

FIELD OF THE INVENTION

The present invention relates to a foldable basketball game assembly wherein the height of the board together with the hoop can be adjusted.

BACKGROUND OF THE INVENTION

A conventional foldable basketball game assembly is disclosed in FIG. 10 and generally includes a base 70 and a top portion 71. The base 70 is composed of several horizontal tubes 701 which are connected with several vertical tubes 702 by three-way connectors 703 and four-way connectors 704 so as to form a rectangular base. The top portion 71 is composed of several horizontal tubes 713 and vertical tubes 714 which are connected to the horizontal tubes 713 by three-way connectors 703 and four-way connectors 704. Two inclined tubes 711 are connected with two short horizontal tubes 712 on each of two sides of the top portion 71 and two nets 72 are located at the two sides of the top portion 71. A surface board 710 is connected to the surface of the top portion 71 and a board 73 is connected to an end of the top portion 71. A loop with a net is connected to the board 73. The whole set needs to be assembled by carefully connecting the tubes at correct positions and orientation, and it takes a lot of assembling time, so that most of the users will not disassemble the assembly which occupies a lot space.

FIG. 11 shows another embodiment of the conventional basketball game assembly which is composed of a bag "A", a body "B", a net "C" and a support portion "D". The bag "A" includes a board "A0" connected to an inside of the base of the bag "A" and a cover "A1" with a zipper "A3" is connected to a side "A2" of the base. The board "A0" includes holes "A01" so as to be hanged on nails on a wall for example, and a handle "A4" is connected to the base of the bag "A" so as to hang the base of the bag "A" on a twig of a tree for example. The board "A0" includes a connection member "A02" which is pivotably connected thereto and a hoop "A03" with a net "A04" are connected to the connection member "A02". The body "B" includes two side portions "B1" and a short tube "B2" is connected between two distal ends of the two side portions "B1". The support portion "D" includes two legs which support the body "B". The two side portions "B1" each are composed of two sections "B11", "B12" and "B13" which are connected with each other by pivotable connection members "E". The whole set can be received in the bag "A". Nevertheless, the assembly needs to be hanged on a wall or tied to a trunk of a tree, this makes the board "A0" not to be well supported and positioned.

The present invention intends to provide a foldable basketball game assembly which can be folded as a flat assembly and the height of the hoop can be adjusted.

SUMMARY OF THE INVENTION

The present invention relates to a foldable basketball game assembly that comprises a base composed of a plurality of horizontal tubes connected with each other by multi-way connectors. An upright frame is connected to the base and includes a plurality of upright tubes which are composed of connection tubes. The connection tubes are connected with each other by connection members, each connection members pivotably connected between two of the connection tubes. A sleeve is movably mounted to each of the upright tubes and removably encloses the connection member. The sleeve is longer than the connection member so as to prevent and the connection tubes from being pivoted relative to the connection members.

A board unit includes a board connected to the upright frame and a sound producing member is connected to the board. A hoop is pivotably connected to the sound producing member. A flexible bar extends from the sound producing member and a sensor is connected to the flexible bar and located in a center of the hoop. An end frame is pivotably connected to the base and located in opposite to the upright frame. A net is connected between the upright frame and the end frame.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 2-1 shows that the sleeve is moved to enclose the connection member;

FIG. 3-1 shows that the end frame which is extended;

FIGS. 4 and 4-1 respectively show two angled position of the end frame;

FIG. 5-1 shows that the upper section of the upright frame is extended;

FIG. 7-1 shows that one of the connection tubes is pivoted relative to the connection member;

DETAILED DESCRIPTION OF THE PREFERRED EMBODIMENT

Figure 1:
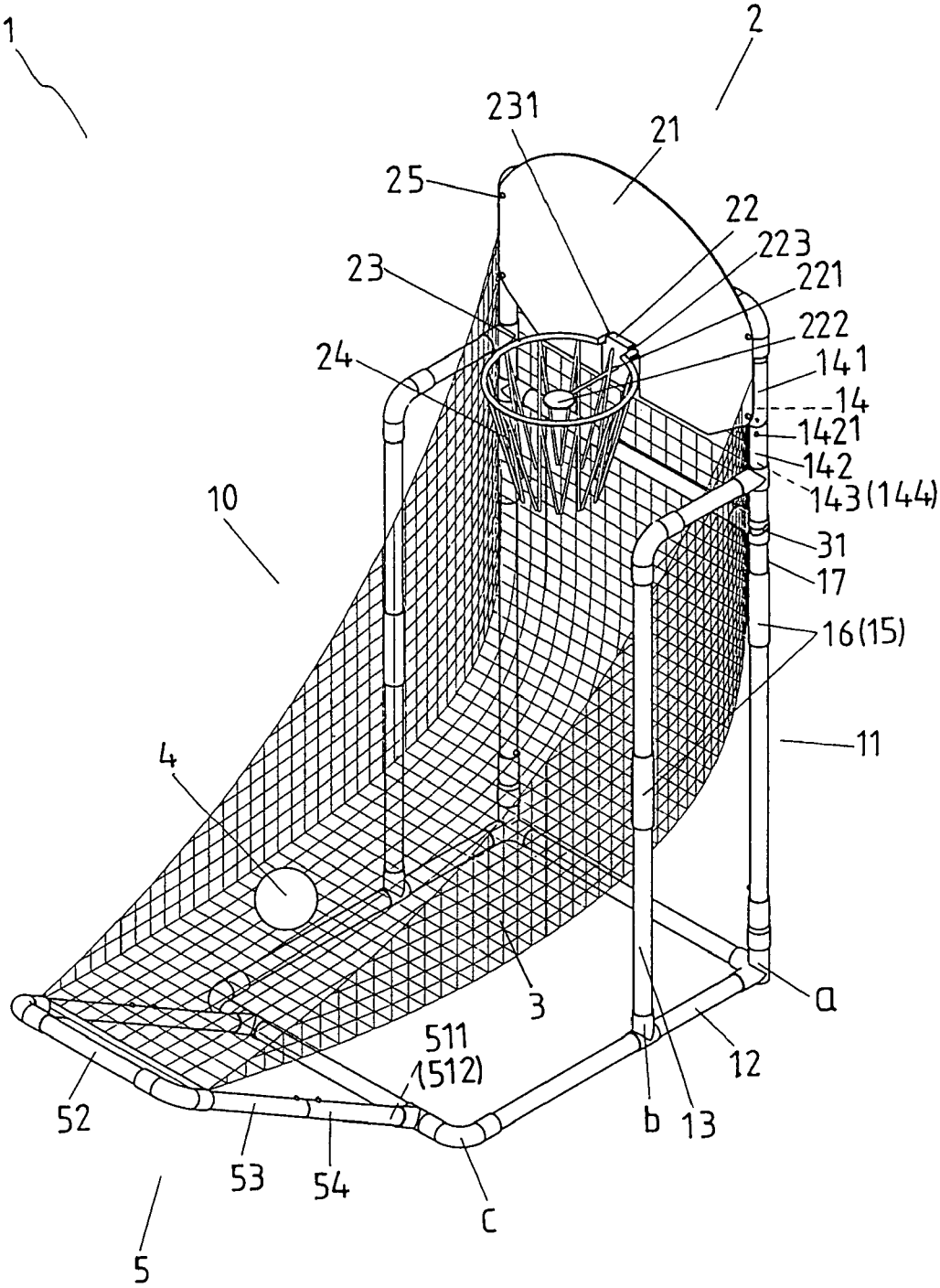
FIG. 1 is a perspective view to show the basketball game assembly of the present invention.

Referring to FIG. 1, the foldable basketball game assembly 1 of the present invention comprises a rectangle base 10 composed of a plurality of horizontal tubes 12 which are connected with each other by multi-way connectors such as three-way connectors "a", T-shaped connectors "b" and elbow-shaped connectors "c".

Figure 2:
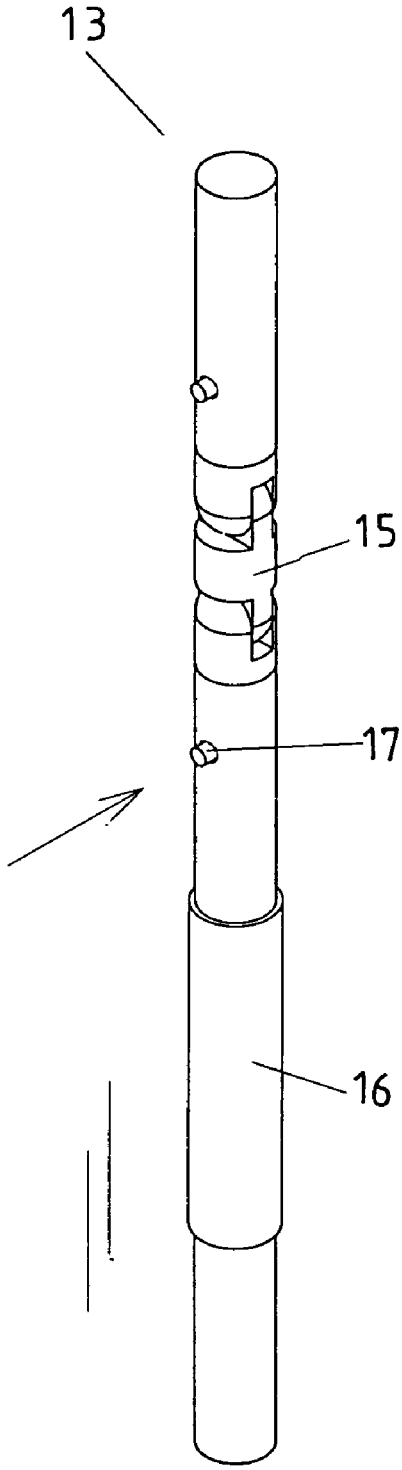
FIG. 2 shows that the sleeve is not yet moved to enclose the connection member.
Figures 1, 2:
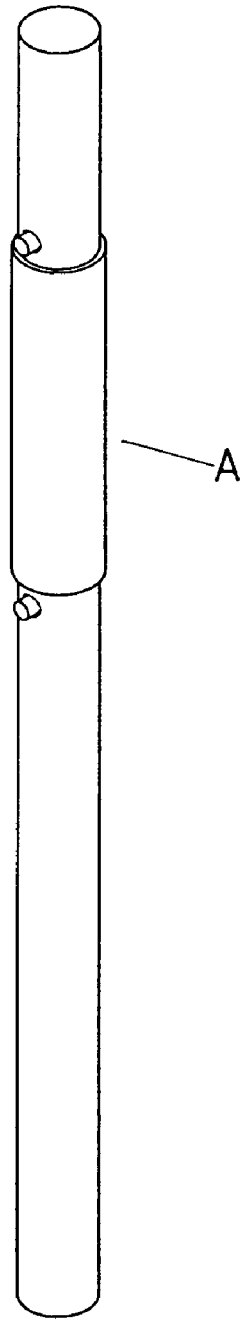

Further referring to FIGS. 2 and 2-1, an upright frame is connected to one end of the base 10 and includes a plurality of upright tubes 11 which are composed of connection tubes 13, and the connection tubes 13 are connected with each other by connection members 15. Each connection member 15 is pivotably connected between two of the connection tubes 13. A sleeve 16 is movably mounted to each of the upright tubes 11 and can be removably encloses the connection member 15. The sleeve 16 is longer than the connection member 15 so as to prevent and the connection tubes 13 from being pivoted relative to the connection members 15. Each upright tube 11 has a positioning piece 17 which is retractably extended from an outer periphery of the upright tube 11, the sleeve 16 is located between the two respective positioning pieces 17 of the two upright tubes 11 on two ends of the connection member 15 when the sleeve 16 encloses the connection member 15 as shown in FIG. 2-1.

A board unit 2 includes a board 21 connected to the upright frame by fixing members 25 such as screws, and a sound producing member 22 is connected to the board 21. A hoop 23 is pivotably connected to the sound producing member 22 by inserted two ends 231 into two side holes 223 defined in two ends of the sound producing member 22. A net 24 is connected to the hoop 23. A flexible bar 221 extends from the sound producing member 22 and a sensor 222 is connected to the flexible bar 221 and located in a center of the hoop 23, so that when a basketball 4 enters the hoop 23, the sensor 222 is touched and a pre-set sound is produced.

Figure 4:
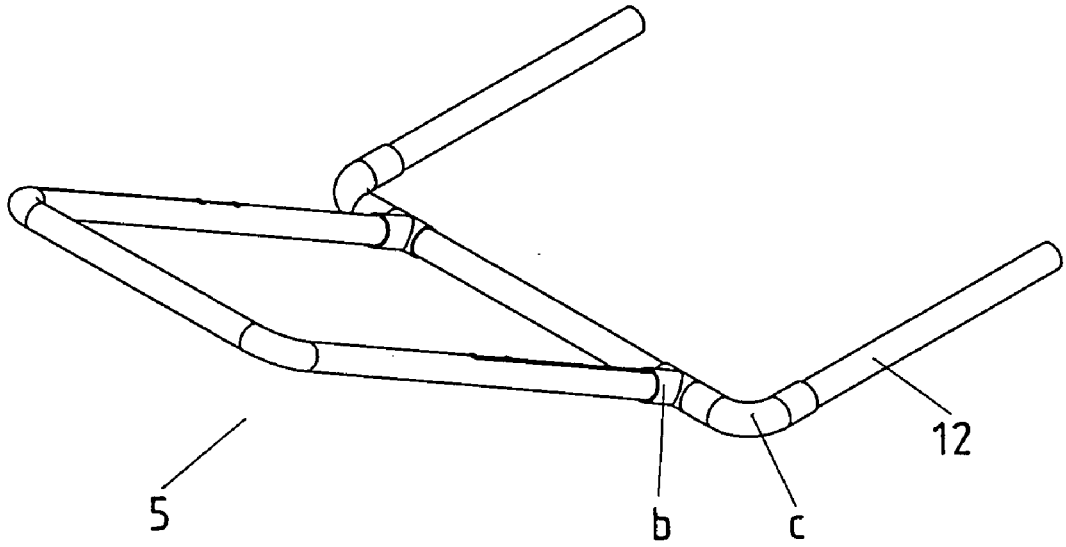
Figures 1, 4:
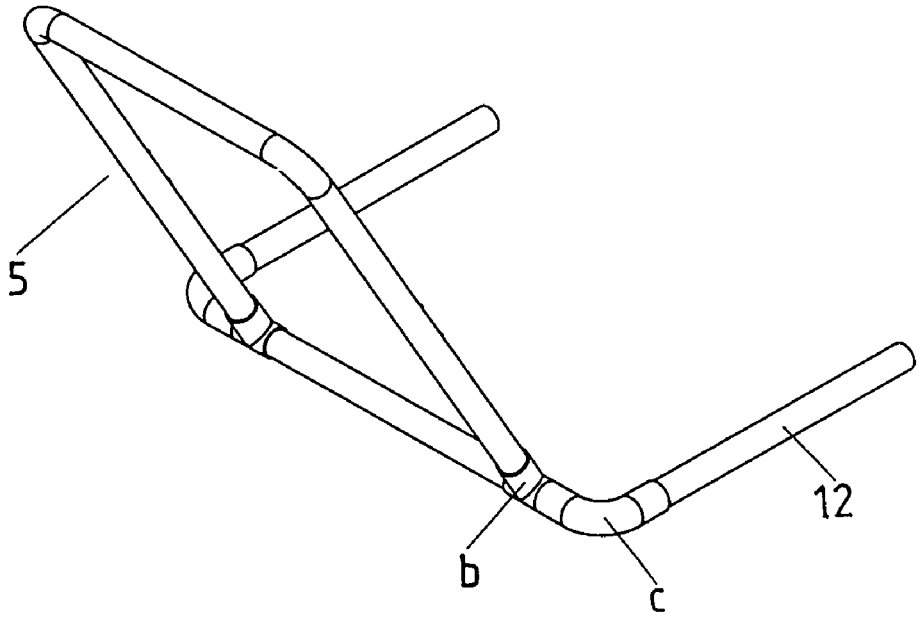

An end frame 5 is pivotably connected to the other end of the base 10 and located in opposite to the upright frame. A net 3 is connected between the upright frame and the end frame 5 by ropes 31 or the like. As shown in FIGS. 4 and 4-1, the end frame 5 can be pivoted to different angles relative to the base 10.

Figure 5:
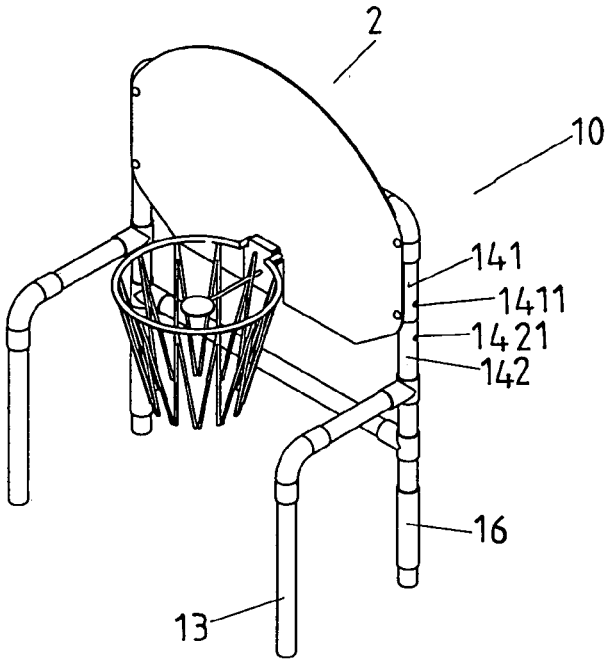
FIG. 5 shows that the upper section of the upright frame is not yet extended.
Figures 1, 5:
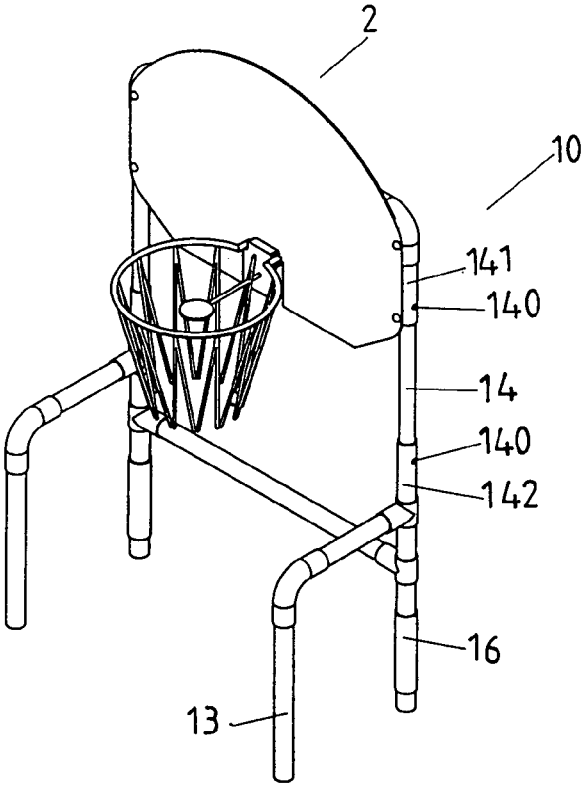
Figure 6:
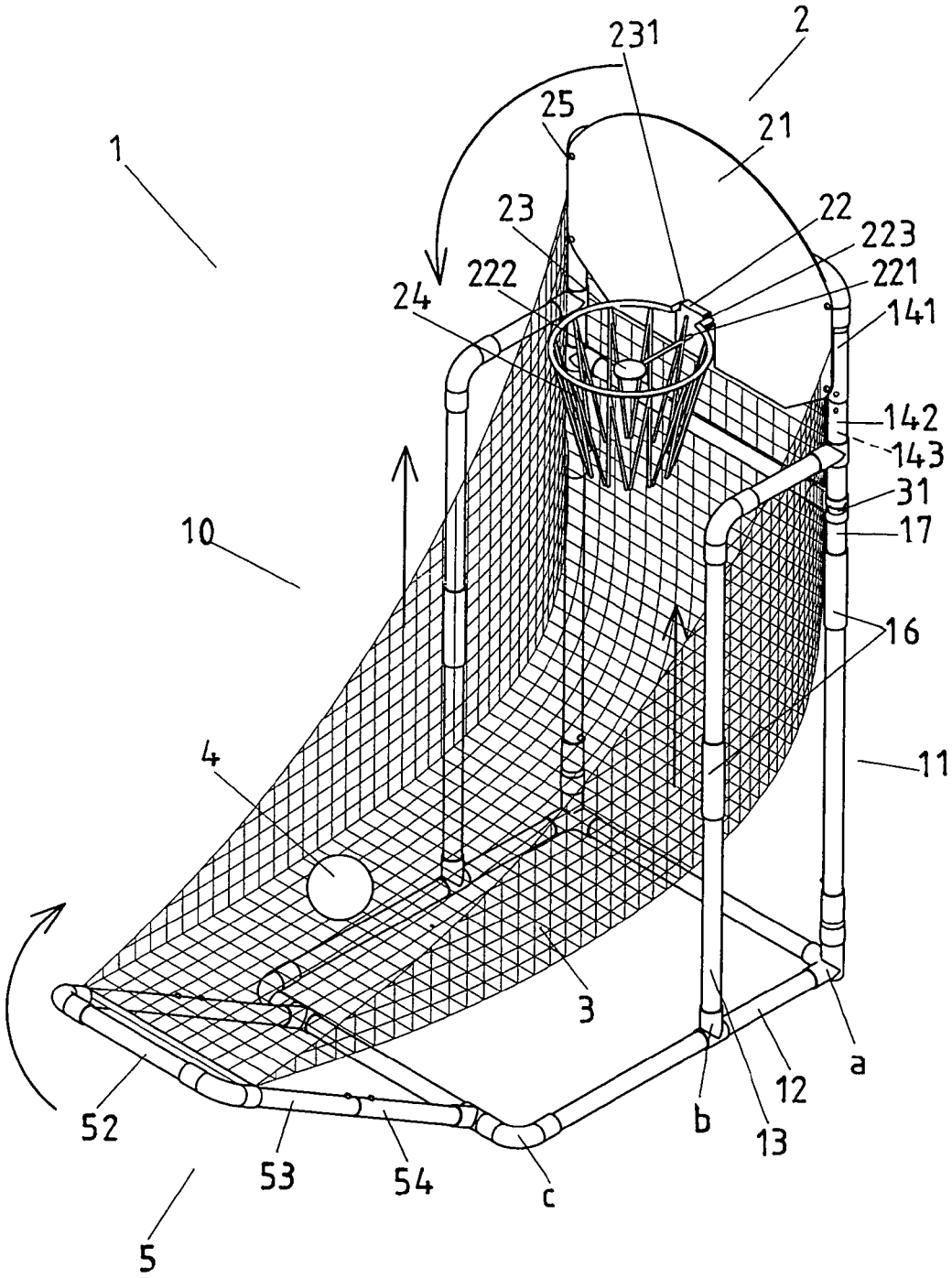
FIG. 6 shows the basketball game assembly is to be folded.
Figure 7:
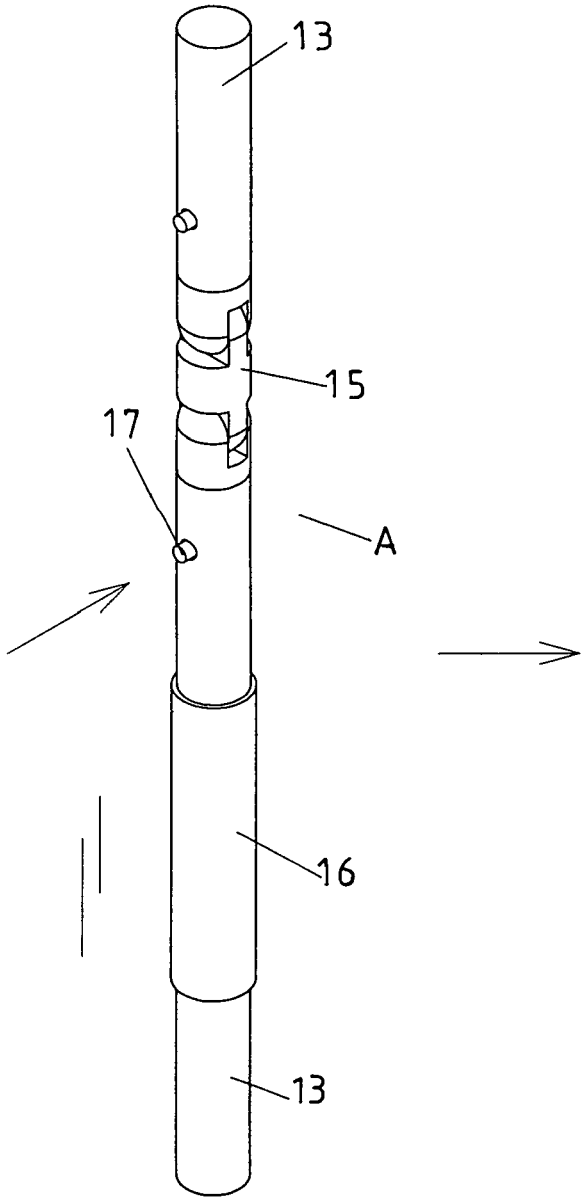
FIG. 7 shows that the sleeve is removed from the connection member of the upright tube.
Figures 1, 7:
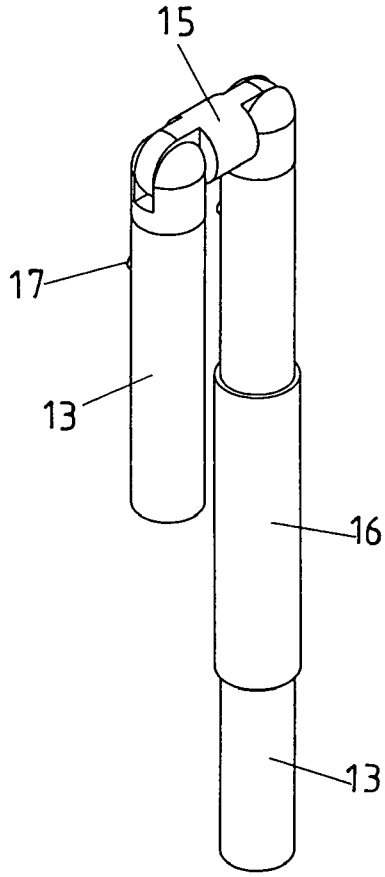

Referring to FIGS. 5 and 5-1, the upright frame includes a U-shaped upper section to which the board 21 is connected. The upper section is composed of two legs and a transverse section connected between the two legs. Each leg comprises a first tube 141, a second tube 142 and a third tube 14 whose two ends are retractably received in the first tube 141 and the second tube 142. The third tube 14 includes two retractable pieces 140 extending from an outer periphery thereof. The first tube 141 has a first hole 1411 and the second tube 142 has a second hole 1421, the two retractable pieces 140 are inserted in the first hole 1411 and the second hole 1421 when the two legs of the upper section are extended as shown in FIG. 5-1. In this extended position, the board 21 and the hoop 23 are at a higher position. If the third tube 14 is completely received in the first and second tubes 141, 142 as shown in FIG. 5, the board 21 is in its lower position.

Figure 3:
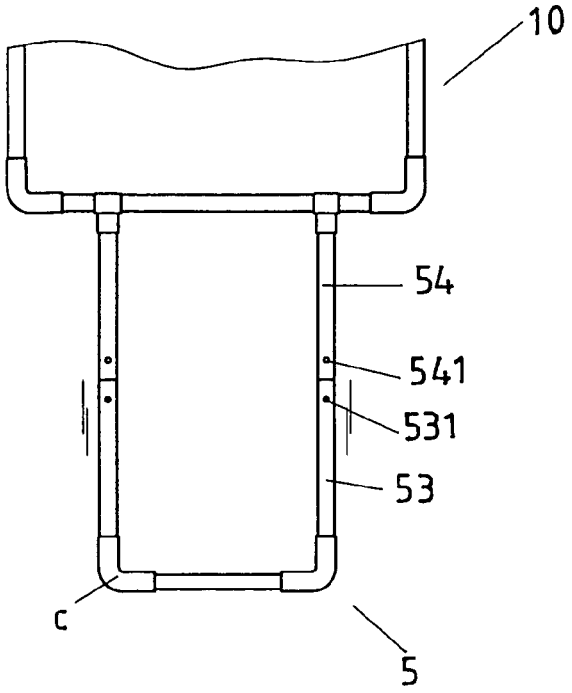
FIG. 3 shows that the end frame which is not extended yet.
Figures 1, 3:
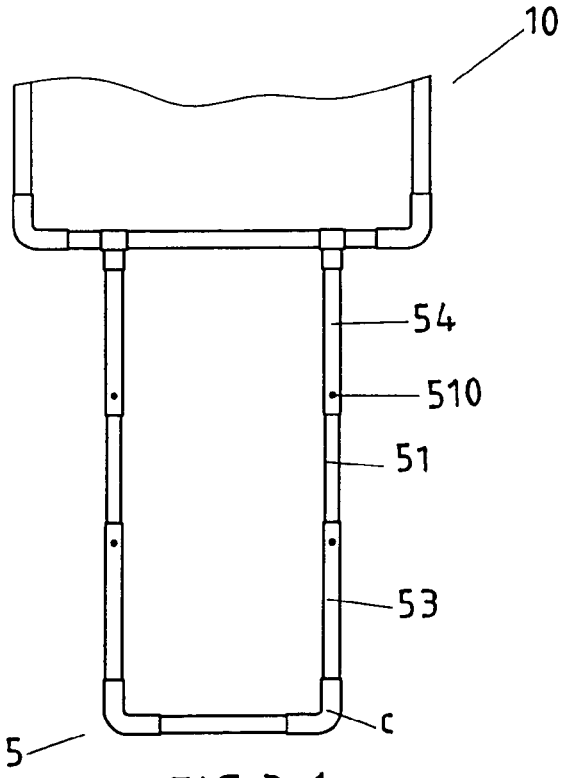

Referring to FIGS. 3 and 3-1, the end frame 5 is a U-shaped frame which is composed of two legs and a transverse section 52 connected between the two legs. Each leg comprises a fourth tube 53, a fifth tube 54 and a sixth tube 51 whose two ends are retractably received in the fourth tube 53 and the fifth tube 54. The sixth tube 51 includes two retractable pieces 510 extending from an outer periphery thereof. The fourth tube 53 has a third hole 531 and the fifth tube 54 has a fourth hole 541. The two retractable pieces 510 are inserted in the third hole 531 and the fourth hole 541 when the two legs of the U-shaped frame of the end frame 5 are extended.

Figure 8:
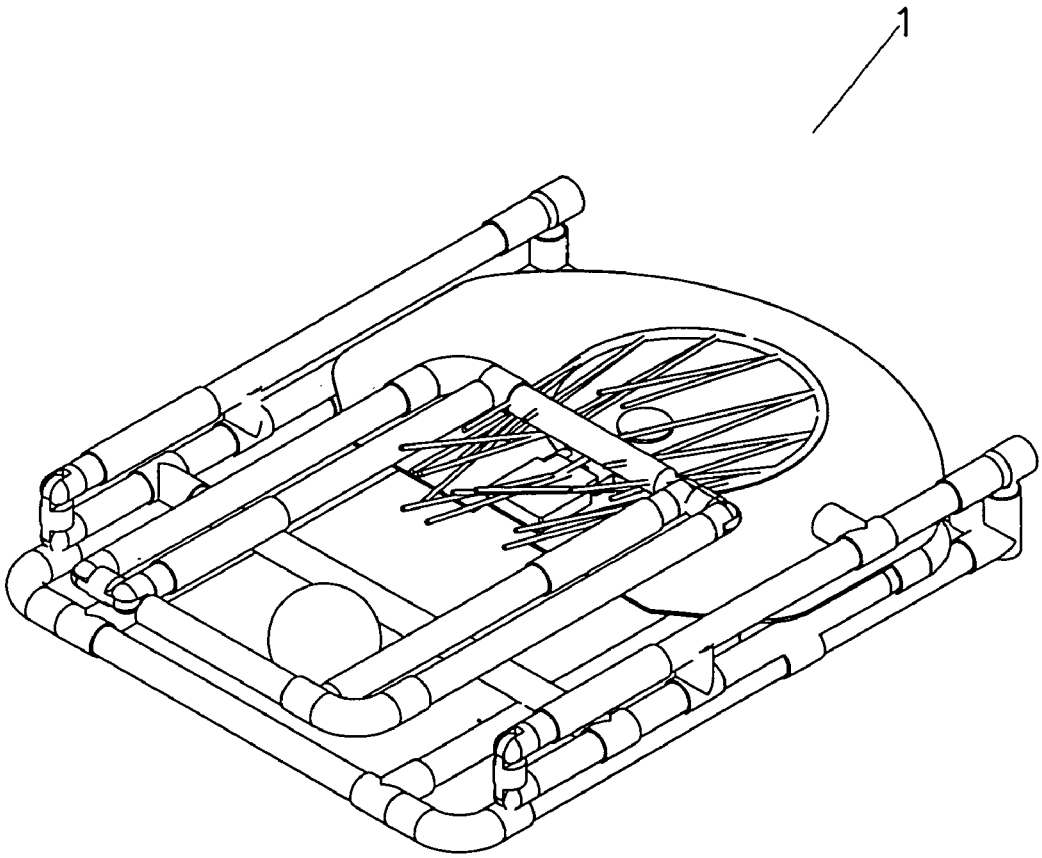
FIG. 8 shows the folded basketball game assembly.
Figure 9:
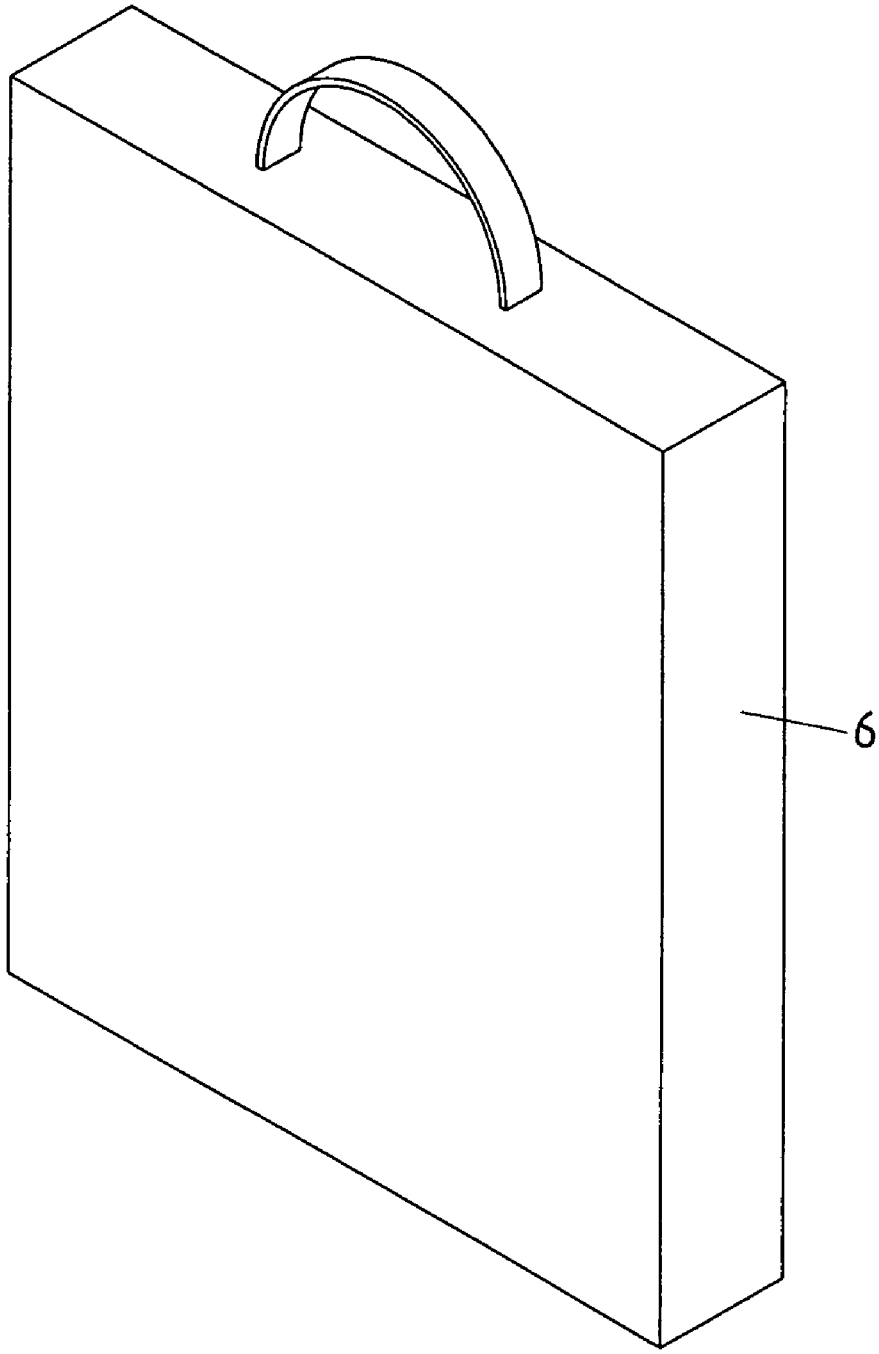
FIG. 9 shows the basketball game assembly can be received in a portable box.
Figure 10:
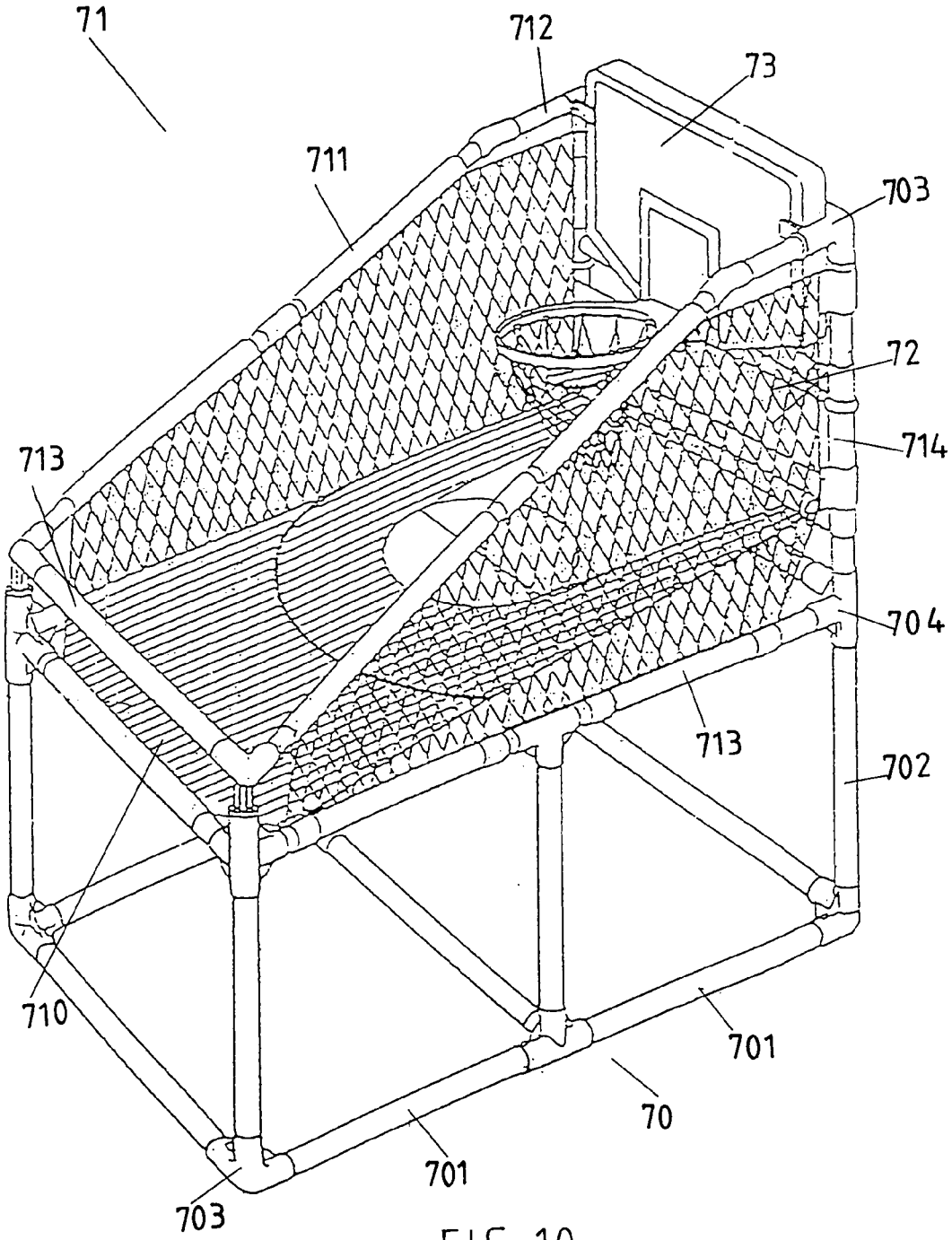
FIG 10 PRIOR ART
FIG. 10 shows a conventional basketball game assembly.
Figure 11:
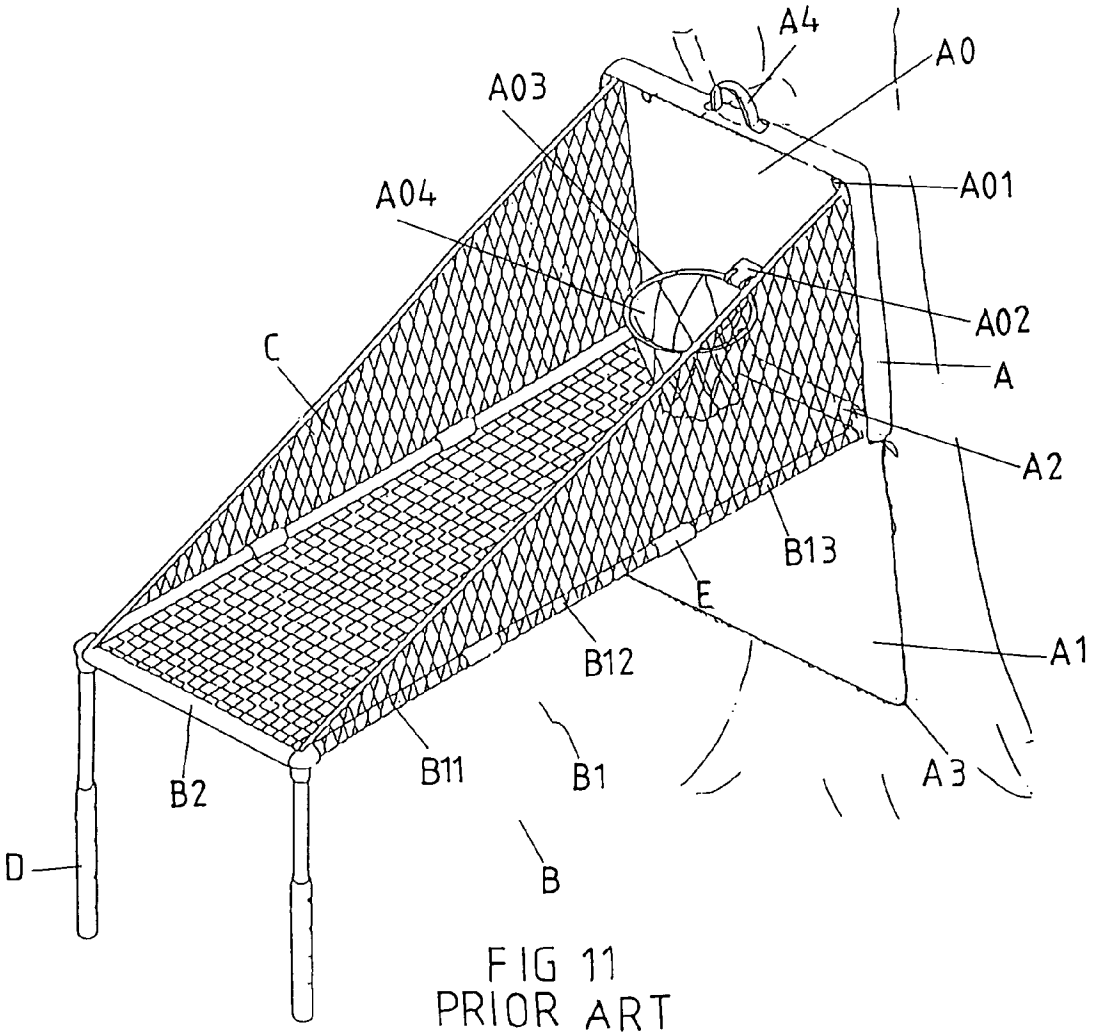
FIG 11 PRIOR ART
FIG. 11 shows another conventional basketball game assembly.

Referring to FIGS. 6, 7, 7-1, 8, and 9, when folding the assembly 1, the connection tubes 13 are removed from the connectors "a" and "b", and shifting the sleeves 16 so that the connection tubes 13 can be pivoted. The end frame 5 is pivoted upward and the hoop 23 is pivoted toward the board 21. The assembly 1 is then folded as a flat assembly as shown in FIG. 8 and can be put in a portable box 6 as shown in FIG. 9.

While we have shown and described the embodiment in accordance with the present invention, it should be clear to those skilled in the art that further embodiments may be made without departing from the scope of the present invention.

What is claimed is:

1. A foldable basketball game assembly comprising:

a base composed of a plurality of horizontal tubes which are connected with each other by multi-way connectors, an upright frame connected to the base and including a plurality of upright tubes which are composed of connection tubes, the connection tubes connected with each other by connection members, each connection members being pivotably connected between two of the connection tubes, each upright tube having a positioning piece which is retractably extended from an outer periphery of the upright tube, a sleeve movably mounted to each of the upright tubes and removably enclosing the connection member, the sleeve located between the two respective positioning pieces of the two upright tubes on two ends of the connection member, the sleeve being longer than the connection member so as to prevent the connection tubes from being pivoted relative to the connection members;

a board unit including a board connected to the upright frame and a sound producing member connected to the board, a hoop pivotably connected to the sound producing member, a flexible bar extending from the sound producing member and a sensor connected to the flexible bar and located in a center of the hoop;

an end frame pivotably connected to the base and located in opposite to the upright frame; and a net connected between the upright frame and the end frame.

2. The assembly as claimed in claim 1, wherein the upright frame includes a U-shaped upper section which is composed of two legs and a transverse section connected between the two legs, each leg comprising a first tube, a second tube and a third tube whose two ends are retractably received in the first tube and the second tube.

3. The assembly as claimed in claim 2, wherein the third tube includes two retractable pieces extending from an outer periphery thereof, the first tube having a first hole and the second tube having a second hole, the two retractable pieces inserted in the first hole and the second hole when the two legs of the upper section are extended.

4. The assembly as claimed in claim 2, wherein the end frame is a U-shaped frame which is composed of two legs and a transverse section connected between the two legs, each leg comprising a fourth tube, a fifth tube and a sixth tube whose two ends are retractably received in the fourth tube and the fifth tube.

5. The assembly as claimed in claim 4, wherein the sixth tube includes two retractable pieces extending from an outer periphery thereof, the fourth tube having a third hole and the fifth tube having a fourth hole, the two retractable pieces inserted in the third hole and the fourth hole when the two legs of the U-shaped frame of the end frame are extended.

* * * * *